US009310714B2

(12) United States Patent
Ozaki et al.

(10) Patent No.: US 9,310,714 B2
(45) Date of Patent: Apr. 12, 2016

(54) IMAGE FORMING APPARATUS

(71) Applicants: Naoyuki Ozaki, Kanagawa (JP); Ryota Kidera, Tokyo (JP); Hiroyuki Sugiyama, Kanagawa (JP); Ryusuke Mase, Kanagawa (JP); Tatsumi Yamada, Kanagawa (JP); Tomoko Takahashi, Kanagawa (JP); Masahiko Shakuto, Kanagawa (JP); Yasunobu Takagi, Kanagawa (JP)

(72) Inventors: Naoyuki Ozaki, Kanagawa (JP); Ryota Kidera, Tokyo (JP); Hiroyuki Sugiyama, Kanagawa (JP); Ryusuke Mase, Kanagawa (JP); Tatsumi Yamada, Kanagawa (JP); Tomoko Takahashi, Kanagawa (JP); Masahiko Shakuto, Kanagawa (JP); Yasunobu Takagi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/742,596

(22) Filed: Jun. 17, 2015

(65) Prior Publication Data

US 2015/0370196 A1 Dec. 24, 2015

(30) Foreign Application Priority Data

Jun. 19, 2014 (JP) ..... 2014-126422

(51) Int. Cl.
*G03G 15/00* (2006.01)
*G03G 15/08* (2006.01)

(52) U.S. Cl.
CPC ..... *G03G 15/0831* (2013.01)

(58) Field of Classification Search
CPC ..... G03G 15/0831; G03G 15/5041; G03G 15/5058
See application file for complete search history.

(56) References Cited

U.S. PATENT DOCUMENTS 4,914,456 A * 4/1990 Kawano ..... G03G 21/08 347/140
2011/0026943 A1 2/2011 Konishi et al.

FOREIGN PATENT DOCUMENTS

JP 3-119377 5/1991
JP 2001-083843 3/2001

* cited by examiner

*Primary Examiner* — David Gray
*Assistant Examiner* — Thomas Giampaolo, II
(74) *Attorney, Agent, or Firm* — Duft Bornsen & Fettig LLP

(57) ABSTRACT

An image forming apparatus includes a driving device, a transfer body, a toner detector, an error notification device, and a controller. The toner detector detects, at a preparation running and while the driving device drives a latent image bearer, one of a toner adhesion amount at a background portion of the latent image bearer and a toner adhesion amount at a background corresponding region of a transfer body. The error notification device notifies a user of an error with the toner adhesion being equal to or greater than a predetermined threshold value. The driving device stops only a developer bearer after driving both the latent image bearer and the developer bearer at the preparation running, but before a trailing edge of a detection target region of one of the background portion of the latent image bearer and the background corresponding region advances to an opposite position to the toner detector.

9 Claims, 6 Drawing Sheets

IMAGE FORMING APPARATUS

CROSS-REFERENCE TO RELATED APPLICATIONS

This patent application is based on and claims priority pursuant to 35 U.S.C. §119 to Japanese Patent Application No. 2014-126422, filed on Jun. 19, 2014, in the Japan Patent Office, the entire disclosure of which is hereby incorporated by reference herein.

BACKGROUND

1. Technical Field

Exemplary aspects of the present disclosure generally relate to an image forming apparatus that notifies users of errors in a case in which a toner adhesion amount at one of a background portion of a latent image bearer and a background portion of a transfer body onto which a toner image is transferred exceeds a threshold value.

2. Description of the Related Art

There is known an image forming apparatus in which a developing device and a latent image bearer, i.e., a photoconductor are driven without forming a latent image on the photoconductor so as to promote charging of toner in the developing device in a process known as preparation running. During the preparation running, when a power source that outputs a charging bias and a developing bias does not operate properly or a charging device that charges the photoconductor fails, a significant amount of toner may adhere to a background portion also known as a non-image formation area of the photoconductor. In the preparation running, a recording medium is not fed so that users do not notice the adhesion of toner on the photoconductor and hence detection of error is delayed until the recording medium is fed. Delay in the detection of error causes contamination of the machine and damage to a cleaning device that cleans the surface of the photoconductor.

SUMMARY

In view of the foregoing, in an aspect of this disclosure, there is provided an improved image forming apparatus including a latent image bearer, a latent image forming device, a developing device, a driving device, a transfer body, a toner detector, an error notification device, and a controller. The latent image bearer bears a latent image on a surface thereof. The latent image forming device forms the latent image on the surface of the latent image bearer. The developing device includes a developer bearer to develop the latent image with toner carried on the developer bearer. The driving device drives the latent image bearer and the developer bearer together and individually. The toner on the surface of the latent image bearer is transferred onto the transfer body. The toner detector detects a toner adhesion amount of toner adhered to one of the surface of the latent image bearer and a surface of the transfer body. The error notification device to notify a user of occurrence of error. The controller controls the toner detector to detect, at a preparation running and while the driving device drives the latent image bearer, one of a toner adhesion amount at a background portion of the latent image bearer and a toner adhesion amount at a background corresponding region of the transfer body in a toner adhesion amount detection, and controls the error notification device to notify the user of occurrence of errors in an error notification in a case in which the toner adhesion amount detected in the toner adhesion amount detection is equal to or greater than a predetermined threshold value. The controller controls the driving device to stop only the developer bearer after driving both the latent image bearer and the developer bearer at the preparation running, but before a trailing edge of a detection target region of one of the background portion of the latent image bearer and the background corresponding region, at which the toner adhesion amount is detected, advances to an opposite position to the toner detector.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
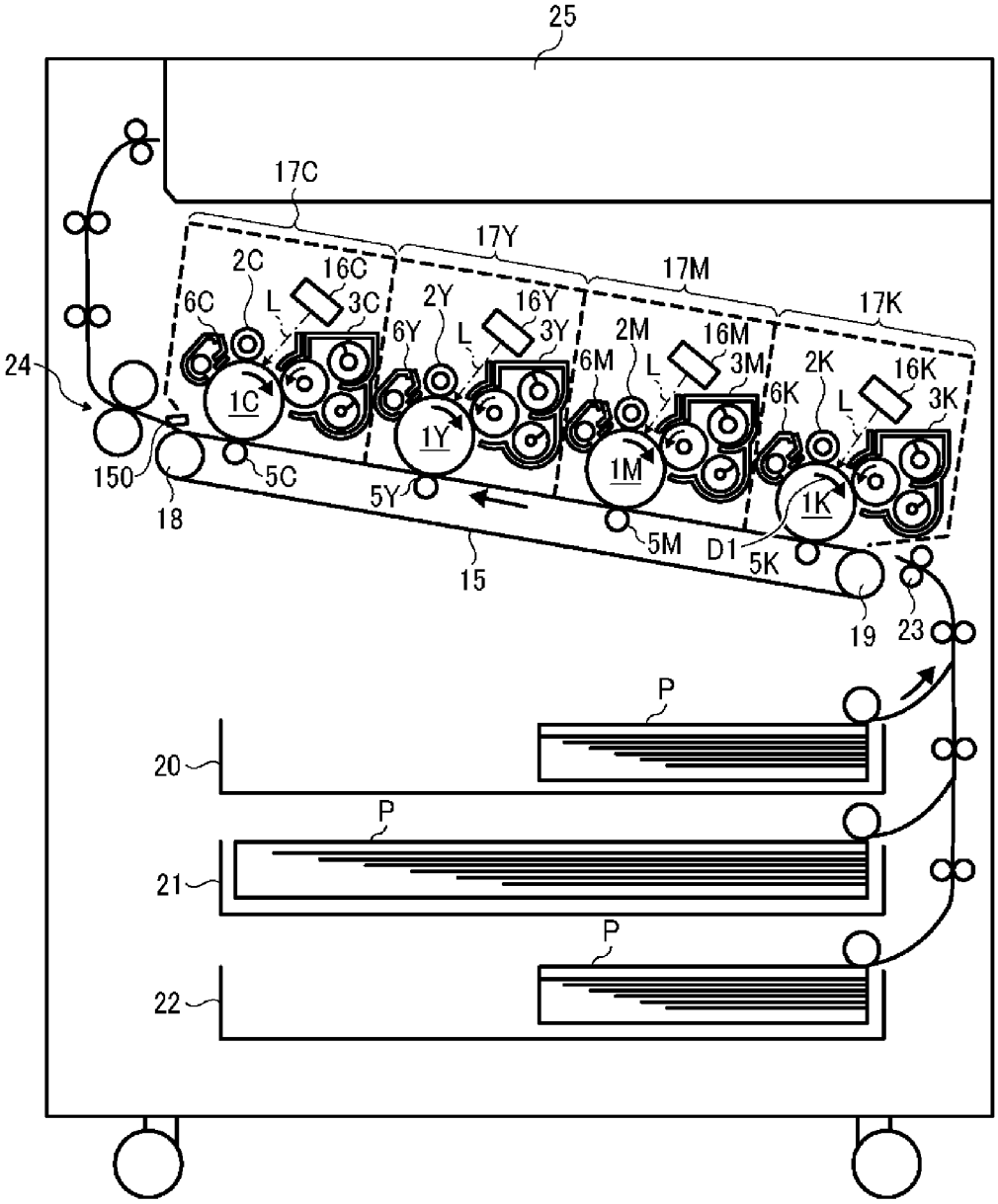
FIG. 1 is a schematic diagram illustrating a printer as an example of an image forming apparatus, according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, exemplary embodiments of the present patent application are described.

With reference to FIG. 1, a multicolor laser printer is described below as an example of an image forming apparatus according to an illustrative embodiment of the present disclosure.

FIG. 1 is a schematic diagram illustrating the image forming apparatus according to an illustrative embodiment of the present disclosure. The image forming apparatus includes four image forming units 17K, 17M, 17Y, and 17C that form toner images of black, magenta, yellow, and cyan, respectively. It is to be noted that the suffixes K, M, Y, and C denote colors black, magenta, yellow, and cyan, respectively. Thereafter, to simplify the description, these suffixes are omitted herein, unless otherwise specified. The image forming apparatus includes a first paper cassette 22, a second paper cassette 21, and a third paper cassette 20, a paper passage, a transfer unit, a fixing unit 24, a paper stack portion 25, and so forth. It is to be noted that the suffixes K, M, Y, and C denote colors black, magenta, yellow, and cyan, respectively. Thereafter, to simplify the description, these suffixes are omitted herein, unless otherwise specified.

The image forming units 17K, 17M, 17Y, and 17C include drum-shaped latent image bearers, that is, photoconductors 1K, 1M, 1Y, and 1C, respectively. The image forming apparatus includes charging devices for each of the colors black, magenta, yellow, and cyan, developing devices 3K, 3M, 3Y, and 3C, photoconductor cleaners 6K, 6M, 6Y, and 6C, and optical writing units 16K, 16M, 16Y, and 16C.

Each of the photoconductors 1K, 1M, 1Y, and 1C is comprised of a drum-shaped base tube made of aluminum or the like on which an organic photosensitive layer is disposed. The photoconductors 1K, 1M, 1Y, and 1C are rotated in a clockwise direction indicated by arrow D1 by a driving device. The optical writing units 16K, 16M, 16Y, and 16C irradiate the photoconductors 1K, 1M, 1Y, and 1C with modulated writing light beams L based on image information received from an external device such as a personal computer (PC), thereby forming an electrostatic latent image on each of the photoconductors 1K, 1M, 1Y, and 1C.

Figure 2:
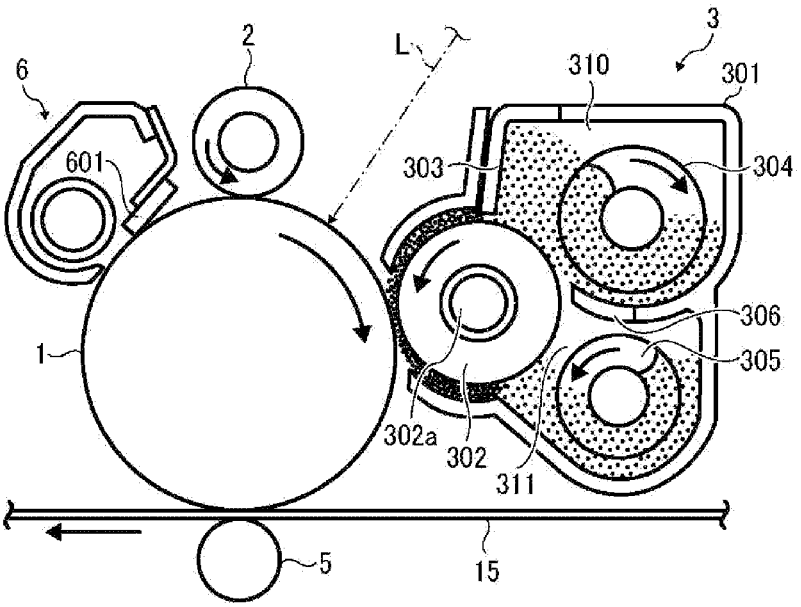
FIG. 2 is an enlarged schematic diagram illustrating an image forming unit for the color black as an example of image forming units employed in the image forming apparatus of FIG. 1.

FIG. 2 is an enlarged schematic diagram illustrating the image forming unit 17K for the color black as an example of image forming units employed in the image forming apparatus of FIG. 1. The image forming units 17K, 17M, 17Y, and 17C all have the same configuration as all the others, differing only in the color of toner employed in the developing devices 3K, 3M, 3Y, and 3C. Thus, the suffixes indicating colors are omitted in FIG. 2. As illustrated in FIG. 2, the developing device 3 includes a developing roller 302, a regulating member 303, a supply chamber 310, a collecting chamber 311, a first conveyor screw 304, a second conveyor screw 305, and so forth inside a casing 301. FIG. 2 shows a proximal portion of the developing device 3 in an axial direction of the developing roller 302.

The developing roller 302 is comprised of a sleeve which is rotated about a rotary shaft, and a magnetic roller disposed inside the sleeve. The magnetic roller is disposed unrotatably inside the sleeve and includes a plurality of magnets arranged in a circumferential direction. The magnetic roller is fixed to a stationary member such as the casing 301 so that the magnets face a predetermined direction. A developing agent is attracted to the magnets of the magnetic roller and carried by the surface of the sleeve. The photoconductor 1 is disposed across a predetermined gap (i.e., developing gap) from the developing roller 302 in a developing region. As a magnetic brush, which is a cluster of developing agent formed in a form of brush on the developing roller 302 due to the magnetic force of the magnetic roller, enters the developing gap, the developing agent moves contacting the photoconductor 1. Subsequently, the electrostatic latent image is developed into a visible image, i.e., a toner image, by supplying the toner to the electrostatic latent image on the photoconductor 1.

The stationary shaft 302*a* of the developing roller 302 is connected to a second power source 113 (shown in FIG. 3) for the developing device 3. A developing bias applied from the second power source 113 to the stationary shaft 302*a* is then applied to the sleeve via a conductive shaft bearing and a conductive rotary shaft. By contrast, a conductive support body of the photoconductor 1 covered with a photosensitive layer is electrically grounded.

In the developing region, the developing potential acts between the electrostatic latent image formed on the photoconductor 1 and the sleeve of the developing roller 302 to which the developing bias is applied, to form an electric field that causes the toner to move from the sleeve side to the latent image side. Accordingly, toner particles separate from magnetic carrier particles on the sleeve of the developing roller 302 and move to the electrostatic latent image.

For the sake of convenience, the optical writing unit such as the optical writing unit 16K of FIG. 1 is not shown in the image forming unit 17K in FIG. 2. Although not illustrated, the image forming unit 17K includes the optical writing unit 16K including an LED array or the like. A charging brush roller 2 (2K, 2M, 2Y, and 2C) as a charging device uniformly charges the surface of the photoconductor 1 that rotates clockwise in FIG. 2 to a negative polarity. According to an illustrative embodiment of the present disclosure, the charging brush roller 2 to which the charging bias is applied is employed as the charging device. The charging brush roller 2 slidably contacts the surface of the photoconductor 1. Alternatively, a scorotron charger or the like may be employed to charge uniformly the photoconductor 1.

The uniformly charged surface of the photoconductor 1 is scanned by the writing light beam L projected from the optical writing unit (for example, the optical writing unit 16K of FIG. 1), so as to attenuate the potential of the exposed portion. As a result, the exposed portion becomes the electrostatic latent image. This process is known as a reversal development method.

As the sleeve of the developing roller 302 rotates, the developing agent on the sleeve passes through the developing region, and the repulsive electric field generated by the magnetic roller causes the developing agent to separate from the surface of the sleeve. As a result, the developing agent separates from the surface of the sleeve. The separated developing agent drops into the collecting chamber 311 by gravity.

The collecting chamber 311 includes the second conveyor screw 305. The supply chamber 310 is disposed immediately above the collecting chamber 311. The supply chamber 310 includes the first conveyor screw 304 inside thereof. The first conveyor screw 304 is disposed lateral to the developing roller 302. The magnetic force from the magnetic roller in the developing roller 302 reaches inside the supply chamber 310. A portion of the developing agent in the supply chamber 310 is attracted to the surface of the sleeve of the developing roller 302 due to the magnetic force. Along with rotation of the sleeve the developing agent is drawn onto the surface of the sleeve. Then, while the developing agent forms the magnetic brush and passes through the gap between the sleeve and the regulating member 303 disposed opposite to the sleeve, the thickness of the layer of the developing agent is adjusted.

The developing agent that has passed through the developing region along with the rotation of the sleeve separates from the surface of the sleeve due to the repulsive electric field, as described above. The separated developing agent drops into the collecting chamber 311 by gravity. With this configuration, the developing agent separated from the sleeve surface immediately after development is prevented from returning to the supply chamber 310 as compared with a configuration in which the collecting chamber is disposed lateral to the supply chamber. Accordingly, even when an image with a high image area ratio is output continuously, the developing agent having a predetermined toner density can be supplied continuously to the sleeve.

The second conveyor screw 305 in the collecting chamber 311 is disposed in such a manner that the axis of rotation of the second conveyor screw 305 is parallel with the axis of rotation of the developing roller 302 and the axis of rotation of the first conveyor screw 304. The second conveyor screw 305 delivers the developing agent from the proximal side to the distal side in the axial direction thereof (i.e., the direction perpendicular to the drawing sheet) along the axis of rotation while rotating and mixing the developing agent.

In the casing 301, the collecting chamber 311 is disposed immediately below the supply chamber 310. The collecting chamber 311 and the supply chamber 310 are separated by a bottom plate 306 of the supply chamber 310. However, the proximal end and the distal end of the supply chamber 310 in the axial direction, that is, in the direction perpendicular to the drawing sheet, do not include the bottom plate 306, thereby allowing the supply chamber 310 and the collecting chamber 311 to communicate. A downstream end of the second conveyor screw 305 in the conveying direction of the developing agent includes a paddle blade instead of a helical flighting.

The paddle blade extends in the direction of axis of rotation. The paddle blade exerts a force to the developing agent in the direction of the normal vector. The developing agent delivered by the helical flighting of the second conveyor screw 305 to the downstream end of the collecting chamber 311 in the conveying direction of the developing agent is lifted up by the paddle blade. The developing agent moves to the supply chamber 310, accordingly.

While the developing agent moved to the supply chamber 310 is delivered from the distal side to the proximal side in the axial direction of the first conveyor screw 304 along with the rotation of the first conveyor screw 304, a portion of the developing agent is picked up by the sleeve of the developing roller 302 and used for development. The developing agent that is not picked up by the sleeve but is delivered to the end portion of the supply chamber 310 moves to the area without the bottom plate 306 and drops into the collecting chamber 311. Subsequently, the developing agent is mixed with toner for supply that is fed via a toner supply outlet disposed in the casing 301.

While being transported near the opposite end in the direction of axis of rotation by the second conveyor screw 305, the supplied toner is stirred and mixed with the developing agent. After stirring and mixing, the developing agent is supplied to the supply chamber 310 by the paddle blade of the second conveyor screw 305. The toner density of the developing agent has a target density.

In the developing device 3 of the present illustrative embodiment, the supply chamber 310 and the collecting chamber 311 are arranged vertically, thereby saving space in the horizontal direction as compared with a horizontal arrangement.

In FIG. 1, toner images in the colors black, magenta, yellow, and cyan are formed on the photoconductors 1K, 1M, 1Y, and 1C, respectively, through the above-described electrophotographic process. The transfer unit is disposed below the image forming units 17K, 17M, 17Y, and 17C. The transfer unit includes a conveyor belt 15 formed into an endless loop and entrained about a plurality of rollers. The conveyor belt 15 serves as a transfer body and travels in the counterclockwise direction. More specifically, the plurality of rollers includes an entry roller 19, a drive roller 18, and four transfer bias rollers 5K, 5M, 5Y, and 5C.

The conveyor belt 15 absorbs electrostatically a front surface of a recording medium P which is fed by a pair of registration rollers 23. Each of the transfer bias rollers 5K, 5M, 5Y, and 5C comprises a metal cored bar covered with an elastic body such as a sponge or the like. The transfer bias rollers 5K, 5M, 5Y, and 5C are pressed against the photoconductors 1K, 1M, 1Y, and 1C to interpose the conveyor belt 15 between the photoconductor 1K, 1M, 1Y, and 1C and the transfer bias rollers 5K, 5M, 5Y, and 5C. Accordingly, the place of contact called transfer nips at which the four photoconductors 1K, 1M, 1Y, and 1C and the conveyor belt 15 contact for a certain distance in the direction of travel of the conveyor belt 15 are formed.

A transfer bias power source applies a transfer bias under constant current control to the metal cored bars of the transfer bias rollers 5K, 5M, 5Y, and 5C. Accordingly, the rear surface of the conveyor belt 15 is supplied with transfer electrical charges via the transfer bias rollers 5K, 5M, 5Y, and 5C, thereby forming a transfer electric field in the transfer nips between the conveyor belt 15 and the photoconductors 1K, 1M, 1Y, and 1C. According to the present illustrative embodiment, the transfer bias rollers 5K, 5M, 5Y, and 5C are employed as the transfer device. Alternatively, in some embodiments, a brush or a blade is employed as the transfer device. Furthermore, a transfer charger may be employed.

As illustrated in FIG. 1, the first paper cassette 22, the second paper cassette 21, and the third paper cassette 20 storing a bundle of recording media P are vertically disposed substantially at the bottom of the image forming apparatus. Each of the first paper cassette 22, the second paper cassette 21, and the third paper cassette 20 stores a bundle of recording media P, and a feed roller pressingly contacts the top sheet. The feed roller is rotated at a predetermined timing to feed the recording medium P to a sheet passage. A plurality of conveyor roller pairs is disposed in the sheet passage, and the recording medium P fed to the sheet passage is interposed between the conveyor roller pairs and delivered to the vicinity of the end of the sheet passage.

Substantially at the end of the sheet passage, the pair of registration rollers 23 is disposed. Although the pair of registration rollers 23 rotates to interpose the recording medium P between the rollers, both rollers stop rotating immediately after catching the leading end of the recording medium P. The pair of registration rollers 23 starts to rotate again to feed the recording medium P to the transfer unit in appropriate timing such that in the transfer nip for the color black the recording medium P is aligned with the toner image in the color black formed on the photoconductor 1K.

A description is now provided of printing operation when printing out a multicolor image below. When receiving data of a multicolor image from a personal computer or the like, the conveyor belt 15 and the photoconductors 1K, 1M, 1Y, and 1C are driven. The toner images in the color of black, magenta, yellow, and cyan are formed on the photoconductors 1K, 1M, 1Y, and 1C, respectively, and the pair of registration rollers 23 feeds the recording medium P at the predetermined timing. Subsequently, the recording medium P carried on the conveyor belt 15 is delivered from the lower right to the upper left in FIG. 1 as the conveyor belt 15 travels, and the recording medium P passes through the transfer nips for black, magenta, yellow, and cyan, respectively. The toner images in the color of black, magenta, yellow, and cyan on the photoconductors 1K, 1M, 1Y, and 1C are transferred onto the recording medium P such that they are superimposed one atop the other in the transfer nips, thereby forming a multicolor image on the recording medium P.

After the multicolor image is formed on the recording medium P, the recording medium P carried on the conveyor belt 15 is delivered to the drive roller 18 around which the conveyor belt 15 is wound, as the conveyor belt 15 travels. The conveyor belt 15 is wound around the drive roller 18 at a sharp winding angle such that the direction of travel of the conveyor belt 15 is almost reversed. With the sharp change in the direction of travel, the recording medium P absorbed to the conveyor belt 15 is separated from the conveyor belt 15 and fed to the fixing unit 24.

The fixing unit 24 includes a fixing roller and a pressing roller. The fixing roller includes a heat source such as a halogen lamp inside thereof. While rotating, the pressing roller pressingly contacts the fixing roller, thereby forming a heated area called a fixing nip therebetween. As the recording medium P passes through the fixing nip in the fixing unit 24, heat and pressure are applied to the toner image on the recording medium P and the toner image is fixed on the recording medium P. Subsequently, the recording medium P is output from the fixing unit 24 and enters a paper output path. The paper stack portion 25 is formed on the upper surface of a main body of the image forming apparatus. The recording medium P is output onto the paper stack portion 25 via a pair of paper output rollers disposed at the end of the paper output path.

After the photoconductor 1 passes through the transfer nip at which the conveyor belt 15 contacts the photoconductor 1, residual toner not having been transferred onto the recording medium P remains on the surface of the photoconductor 1. The residual toner is removed from the conveyor belt 15 by a cleaning blade 601 of the photoconductor cleaner 6. Subsequently, a discharge lamp removes electric charges remaining on the surface of the photoconductor 1. After that, the charging brush roller 2 of the charging device charges uniformly the surface of the photoconductor 1 again in preparation for the subsequent imaging cycle.

Figure 3:
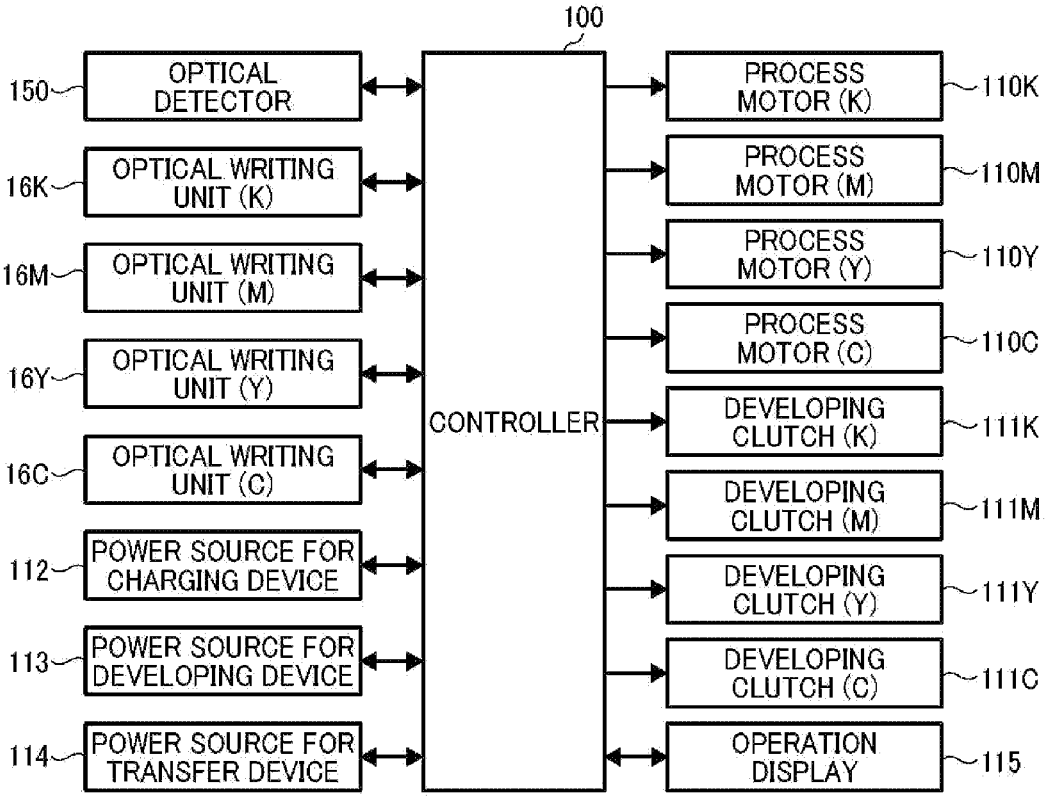
FIG. 3 is a block diagram illustrating a portion of an electrical circuit of the image forming apparatus.

FIG. 3 is a block diagram illustrating a portion of an electrical circuit of the image forming apparatus according to an illustrative embodiment of the present disclosure. As illustrated in FIG. 3, a controller (processor) 100 includes a Central Processing Unit (CPU), a Random Access Memory (RAM) that temporarily stores data, and a Read Only Memory (ROM) that stores a control program, a flash memory, and so forth. The controller 100 enables various calculations and communications with various detectors, and drives driving devices. The optical writing units 16K, 16M, 16Y, and 16C, a first power source 112 for the charging device, the second power source 113 for the developing device 3, a third power source 114 for the transfer device, an operation display 115 serving as an error notification device, the optical detector 150, and so forth are connected to the controller 100. Furthermore, process motors 110K, 110M, 110Y, and 110C, developing clutches 111K, 111M, 111Y, and 111C, and so forth are also connected to the controller 100.

As described above, the optical writing units 16K, 16M, 16Y, and 16C write electrostatic latent images on the photoconductors 1K, 1M, 1Y, and 1C, respectively, through optical scanning. Furthermore, the process motors 110K, 110M, 110Y, and 110C are motors serving as drive sources for the image forming units 17K, 17M, 17Y, and 17C. Power transmission devices for each of the colors black, magenta, yellow, and cyan are connected to the process motors 110K, 110M, 110Y, and 110C. The power transmission devices transmit rotary driving forces of the process motors 110K, 110M, 110Y, and 110C to the photoconductors 1K, 1M, 1Y, and 1C, and the developing sleeves of the developing devices 3K, 3M, 3Y, and 3C.

The power transmission devices for each of the colors black, magenta, yellow, and cyan include the developing clutch 111K, the developing clutch 111M, the developing clutch 111Y, and the developing clutch 111C, thereby turning on and off the transmission of power to the developing sleeves. With this configuration, the photoconductors 1K, 1M, 1Y, and 1C can be driven independently from the developing sleeves. According to the present illustrative embodiment of the present disclosure, the process motor, the power transmission device, the developing clutch, and so forth constitute the driving device.

The first power source 112 outputs a charging bias to be applied to the charging brush rollers 2K, 2M, 2Y, and 2C of the charging device. The second power source 113 outputs a developing bias to be applied to the developing sleeves of the developing devices 3K, 3M, 3Y, and 3C. The third power source 114 outputs a transfer bias to be applied to the transfer bias rollers 5K, 5M, 5Y, and 5C. According to the present illustrative embodiment, in a monochrome print mode, the conveyor belt 15 is separated from the photoconductors 1M, 1Y, and 1C and contacts only the photoconductor 1K by changing the orientation of the stretched surface of the conveyor belt 15. In this state, only the image forming unit 17K among the image forming units 17K, 17M, 17Y, and 17C is activated to form a toner image of black on the photoconductor 1K. The first power source 112 outputs the charging bias only to the charging brush roller 2K.

In order to allow such an output, the electrical path for the charging bias for the color black is established independent of the electrical paths for the charging bias for the colors magenta, yellow, and cyan. In the monochrome print mode, the second power source 113 outputs a developing bias only to the developing sleeve of the developing device 3K. In order to allow such an output, the electrical path for the developing bias for the color black is established independent of the electrical paths for the developing bias for the colors magenta, yellow, and cyan.

In the monochrome print mode, the third power source 114 outputs a transfer bias only to the transfer bias roller 5K among the transfer bias rollers 5K, 5M, 5Y, and 5C. In order to allow such an output, the electrical path for the transfer bias for the color black is established independent of the electrical paths for the transfer bias for the colors magenta, yellow, and cyan.

The operation display 115 as an error notification device includes a numerical keypad, a touch screen, and so forth. The operation display 115 allows users to enter instructions and shows text and graphic images on the touch screen. By showing a predetermined text and graphic images on the touch screen, the user is notified of an occurrence of error.

In order to facilitate an understanding of the novel features of the present disclosure, as a comparison, a description is now provided of a comparative example of an image forming apparatus.

The comparative example of an image forming apparatus includes a reflective-type photosensor to detect a toner adhesion amount at the background portion of the photoconductor during the preparation running. When the detection result exceeds a threshold, it is determined that an error has occurred. Then, the user is notified of the error. It is said that when the user is notified of the error during the preparation running, contamination of the machine and damage to the cleaning device are prevented.

However, a certain amount of time is required to determine the presence of error based on the detection of toner adhesion amount by the reflective-type photosensor after the preparation running is started. In a case in which the error is present, toner continues to stick to the photoconductor until the presence of the error is determined.

In this type of an image forming apparatus, the developing device and the reflective-type photosensor are disposed around a drum-shaped photoconductor substantially in a point-symmetrical position with respect to the axis of the photoconductor. In this configuration, after the preparation running starts, detection of the toner adhesion amount is started when a portion of the photoconductor that has passed an opposite position to the developing device comes to a position opposite to the reflective-type photosensor. After a predetermined time elapses, detection of the toner adhesion amount is finished, and the presence of error is determined based on the detection result. From the time at which the preparation running starts until the detection of the toner adhesion amount is finished and the error is detected based on the detection result, the toner continues to stick to the photoconductor. In a case in which the toner adhesion amount per unit time due to an error is significant, the machine may be contaminated and the cleaning device may be damaged.

Alternatively, another known image forming apparatus includes a toner detector such as the reflective-type photosensor to detect the toner adhesion amount on a transfer body such as an intermediate transfer belt and a conveyor belt onto which the toner is transferred from the surface of the photoconductor as a latent image bearer. The similar difficulty occurs in this configuration as well.

In view of the above, there is demand for an image forming apparatus capable of preventing contamination of interior of the image forming apparatus due to occurrence of errors.

Referring back to FIG. 1, a description is provided of the optical detector 150 according to an illustrative embodiment of the present disclosure. As illustrated in FIG. 1, the optical detector 150 including a reflective-type photosensor is disposed across from the drive roller 18 via the conveyor belt 15 with a predetermined gap between the optical detector 150 and the portion of the conveyor belt 15 wound around the drive roller 18 in a circumferential direction. The optical detector 150 includes a light emitting element and a light receiving element. The light emitting element projects light against the front surface of the conveyor belt 15. The light receiving element receives specular reflection light reflected on the surface of the conveyor belt 15 and diffuse reflection light. The output voltages of the specular-reflection light receiving element and diffuse-reflection light receiving element of the optical detector 150 change in accordance with a toner adhesion amount of the surface of the conveyor belt 15. The controller 100 can detect the toner adhesion amount of the belt surface based on the output voltages.

During the preparation running immediately after the power is turned on, the controller 100 carries out a detection processing for detection of the toner adhesion amount at the background portion and an error notification processing only for the image forming unit 17K from which images are most frequently output among four colors. More specifically, during the preparation running, while the photoconductor 1K is rotated by the driving device, the charging bias, the developing bias, and the transfer bias for the color black are output from the respective power sources. The black toner adhered to the background portion of the photoconductor 1 is transferred onto the front surface of the conveyor belt 15 at the transfer nip for black. Subsequently, based on the output voltage from the optical detector 150, the black toner adhesion amount of the conveyor belt 15 serving as the transfer body is detected.

After the detection processing for detection of the toner adhesion amount at the background portion, the error notification processing is started. In a case in which the result of detection of the black toner adhesion amount exceeds a predetermined threshold, the operation display 115 shows a text message or a predetermined image to notify the user of the error. Alternatively, in a case in which the result of detection of the black toner adhesion amount is equal to or greater than the predetermined threshold, the user may be notified of the error.

Figure 4:
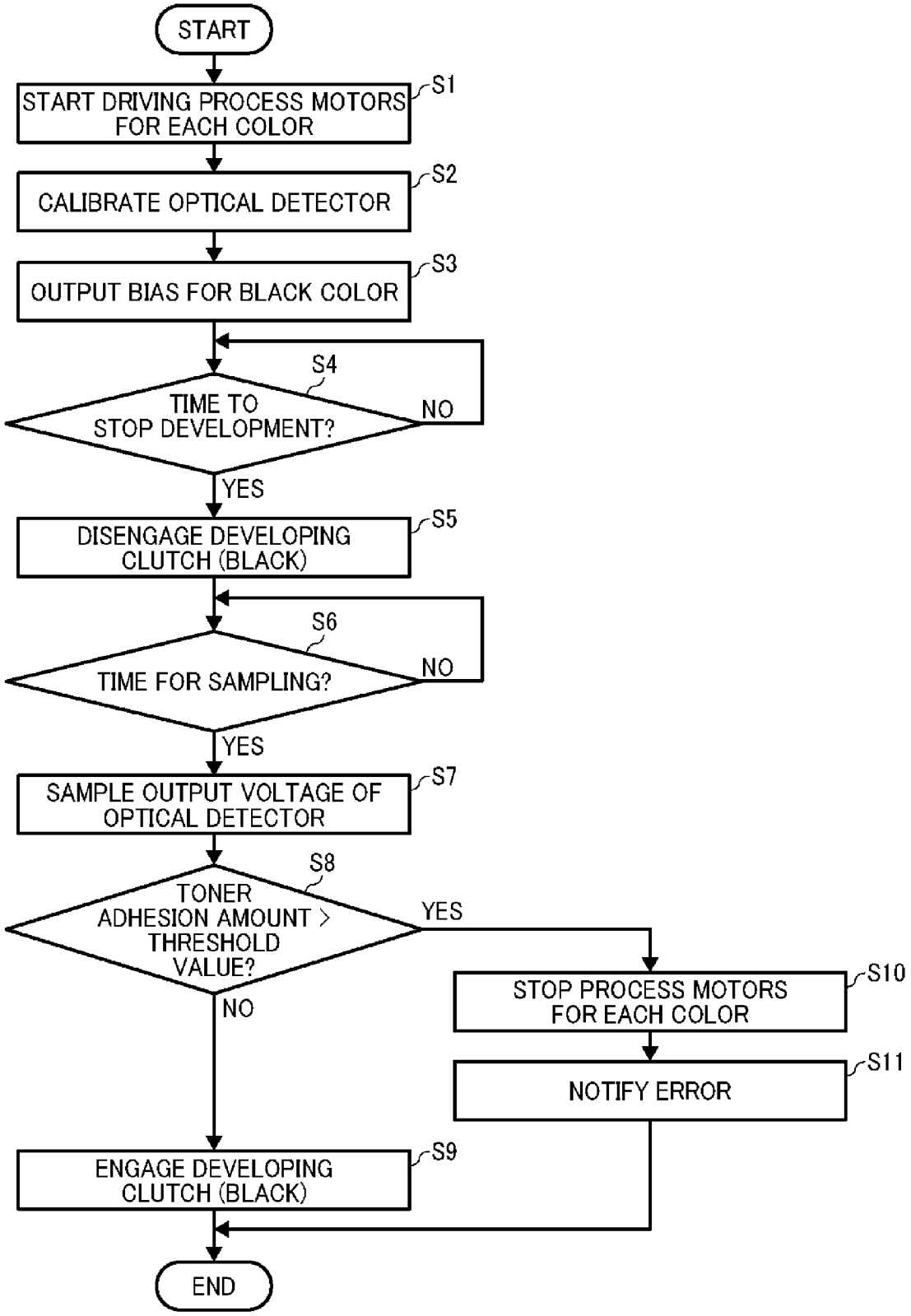
FIG. 4 is a flowchart showing steps of a routine processing performed by a controller of the image forming apparatus during a preparation running.

With reference to FIG. 4, a description is provided of a characteristic configuration of the image forming apparatus according to an illustrative embodiment of the present disclosure.

FIG. 4 is a flowchart showing steps of a routine processing by the controller 100 of the image forming apparatus during the preparation running according to an illustrative embodiment of the present disclosure. Steps S6 through S7 in the flowchart are associated with the detection processing for detection of the toner adhesion amount. Steps S8 through S11 are associated with the error notification processing. When starting the preparation running, the controller 100 starts to drive the process motors 110K, 110M, 110Y, and 110C at step S1. In the meantime, the developing sleeves for each color are rotated by engaging the developing clutches 111K, 111M, 111Y, and 111C. Furthermore, the drive motor for the conveyor belt 15 is also driven so as to rotate the conveyor belt 15 endlessly.

It is to be noted that the start timing at which the photoconductors and the developing sleeves for each color are driven does not have to be the same for all the colors. In some embodiments, the developing sleeves may be driven after a predetermined time elapses from the start of rotation of the photoconductor. Alternatively, the photoconductor may be rotated after a predetermined time elapses after driving the developing sleeve.

Next, at step S2, the controller 100 carries out calibration of the optical detector 150. More specifically, the light intensity of the light emitting element of the optical detector 150 is adjusted such that the output voltage of the specular reflection light receiving element of the optical detector 150 achieves a target value. In this configuration, the output voltage from the specular reflection light receiving element of the optical detector 150 obtains the predetermined value when a detection target is an area of the conveyor belt 150 having no toner adhered thereto.

After calibration of the optical detector 150 at step S2, the controller 100 controls the first power source 112, the second power source 113, and the third power source 114 to output the charging bias, the developing bias, and the transfer bias for the color black, respectively, at step S3. When no error is detected, no black toner adheres to the photoconductor 1K even when these biases are output. However, when errors such as failure of power sources, and damage to bias conductive lines and to the charging brush roller 2K are present, a significant amount of black toner is adhered to the background portion or non-image formation area of the photoconductor 1K. The black toner is transferred onto the surface of the conveyor belt 15 from the photoconductor 1K at the transfer nip for black color.

After the controller 100 enables the power sources to output the respective bias, the controller 100 determines whether or not it is time to stop the developing process at step S4. The time at which the developing process is stopped is a time at which a predetermined time elapses after the developing clutch 111K is engaged.

A description is provided below of the detection timing for detecting the toner adhesion amount by the optical detector 150. In a case in which toner undesirably sticks to the photoconductor 1K due to some errors, when the photoconductor 1K and the developing sleeve start to rotate in the image forming unit 17K, the black toner starts to stick to the photoconductor 1K from the developing sleeve. There is no use if the optical detector 150 performs detection before the black toner transferred to the conveyor belt 15 from the photoconductor 1K in the transfer nip comes to the opposite position to the optical detector 150 in accordance with traveling of the belt. The optical detector 150 needs to detect after an adhered-toner moving period during which the black toner on the photoconductor 1K moves to the belt surface in the transfer nip and then advances to the opposite position to the optical detector 150. The region (detection region) of the conveyor belt 15 to be detected is a region that passes through the opposite position to the optical detector 150 during a time period after the optical detector 150 starts to detect after the adhered-toner moving period until the optical detector 150 finishes the detection.

According to the present illustrative embodiment, the time before the trailing edge of the detection region passes through the opposite position to the optical detector 150 is set as the time to stop the developing process. More specifically, the time at which the developing process is stopped is set after 100 milliseconds (msec), for example, such that the developing sleeve is driven for a certain time period during which the surface of the photoconductor travels for a sufficient distance, allowing the optical detector 150 to detect the toner adhesion amount.

The controller 100 waits until the time to stop the developing process (Yes at S4) and disengages the developing clutch 111K (step S5). Accordingly, only the photoconductor 1K is driven among the photoconductor 1K and the developing sleeve in the image forming unit 17K. Subsequently, at steps S6 and S7, the controller 100 performs the detection processing for detection of the toner adhesion amount at the background portion. More specifically, at step S6, the controller 100 waits for a sampling timing. During the preparation running, no latent image is written on the uniformly-charged background portion of the photoconductor 1K. Thus, the region of the photoconductor 1K that has passed through the opposite position to the charging brush roller 2K is in the state of the background portion entirely until the region advances to the position opposite to the discharge lamp. Even when some kind of error is present, the amount of black toner adhering to a region R2 of the background portion of the photoconductor 1K, the region having passed the opposite position to the developing sleeve which is not rotated (after rotation is stopped), is not significant.

By contrast, a large amount of black toner may stick from the rotating developing sleeve to a region R1 of the background portion of the photoconductor 1K. The region R1 is a region of the background portion having passed the opposite position to the rotating developing sleeve (before rotation is stopped).

The sampling timing refers to a time at which a belt region BR1*k* of the conveyor belt 15 associated with the region R1 of the photoconductor 1K advances to the opposite position to the optical detector 150. The belt region BR1*k* refers to a region of the conveyor belt 15 that has tightly contacted the region R1 of the photoconductor 1K in the transfer nip. This sampling timing can be specified through a time count processing from the time at which the developing clutch 111K is disengaged.

When the sampling timing arrives (Yes at step S6), the controller 110 takes a sample of an output voltage from the optical detector 150 at step S7. Based on the result, the toner adhesion amount of the black toner at the belt region BR1*k* of the conveyor belt 15 is obtained.

Subsequently, after the detection processing for detection of the toner adhesion amount of the background portion, the controller 100 starts the error notification processing. First, whether or not the toner adhesion amount of the black toner previously obtained exceeds a predetermined threshold value is determined at step S8. If it does not exceed (No at step S8), the developing clutch 111K is engaged to start rotation of the developing sleeve again, thereby finishing a sequence of routine processing. By contrast, if the toner adhesion amount of the black toner exceeds the predetermined threshold value (Yes at S8), the image forming units for each color are stopped by stopping the process motors for each color at step S10. In the meantime, output of various biases for black color and driving of the conveyor belt 15 are stopped. Subsequently, using the operation display 115, the user is notified of an occurrence of the error at step S11, thereby finishing a sequence of routine processing.

Conventionally, the developing sleeve keeps rotating during a time after the developing bias is output and until the photoconductor 1K that passed the opposite position to the developing sleeve at the begging of output enters the transfer nip and then the conveyor belt 15 that tightly contacted the photoconductor 1K advances to the opposite position to the optical detector 150. The duration coincides with at least a few seconds. During this time, the black toner keeps sticking from the developing sleeve to the photoconductor 1K, causing contamination of interior of the apparatus and damage to the cleaning blade.

In view of the above, according to the present illustrative embodiment, after the developing bias is output, the developing sleeve is rotated for a short period of time such as 100 msec, and is stopped immediately. With this configuration, the amount of black toner moving from the developing sleeve to the photoconductor 1K is reduced during the preparation running, and hence contamination of interior of the apparatus and damage to the cleaning blade are prevented, thereby preventing malfunction.

Figure 5:
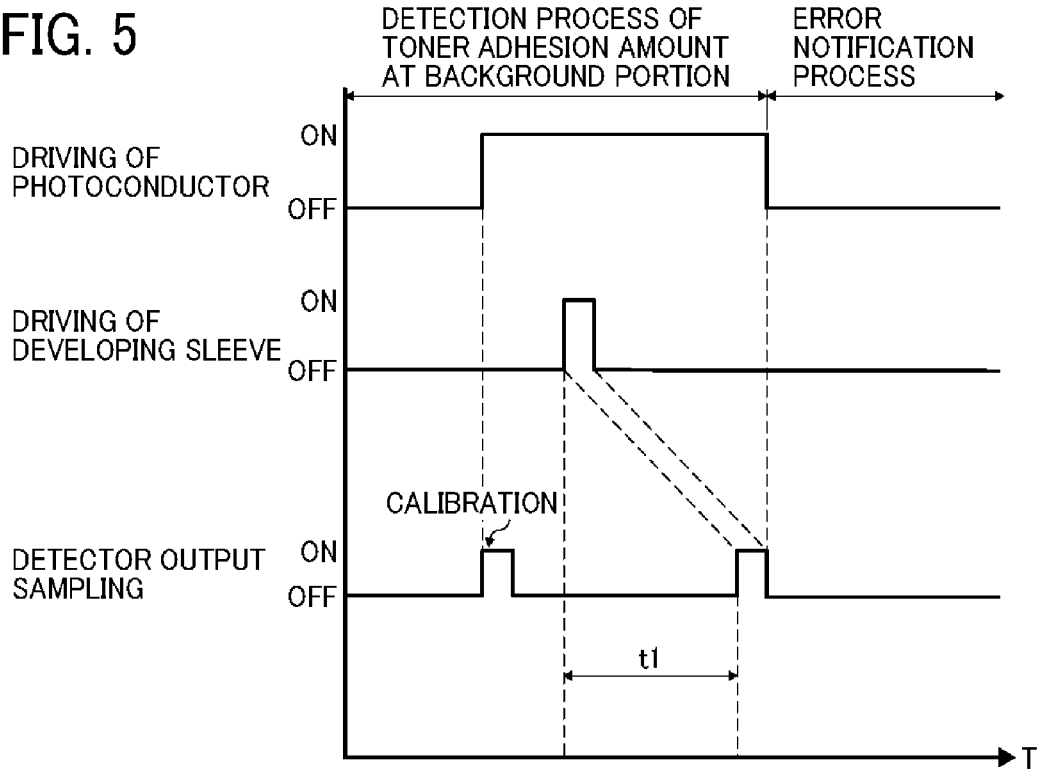
FIG. 5 is a timing diagram showing an operation sequence when an error is present.

FIG. 5 is a timing diagram showing an operation sequence when an error is present. According to the present illustrative embodiment, the photoconductors 1K, 1M, 1Y, and 1C, and the conveyor belt 15 are driven at the same linear velocity (process linear velocity). In FIG. 5, a time t1 is obtained such that a sum of a traveling distance of the surface of the photoconductor 1K in a predetermined transfer time lag and a traveling distance of the conveyor belt 15 in a predetermined sampling time lag is divided by a process linear velocity V. The transfer time lag is a required time for the region R1 of the photoconductor 1K to move from the opposite position to the developing sleeve to the transfer nip for black color. The sampling time lag is a required time for the belt region BR1*k* associated with the region R1 to move from the transfer nip for black to the opposite position to the optical detector 150. In other words, after the region R1 of the photoconductor 1K passes the opposite position to the rotating developing sleeve and then the time t1 elapses, the belt region BR1*k* of the conveyor belt 15 associated with the region R1 of the photoconductor 1K advances to the opposite position to the optical detector 150.

If an error is present, as illustrated in FIG. 5, immediately after the error notification processing starts, the photoconductor 1 is stopped by stopping the process motor.

According to the present illustrative embodiment, as illustrated in FIG. 5, the controller 100 carries out a processing (i.e., sampling the output of the optical detector 150) in which the toner adhesion amount of black toner at the belt region BR1*k* is detected while the developing sleeve serving as a developer bearer is stopped in the detection processing for detection of the toner adhesion amount at the background portion. With this configuration, contamination of the interior of the apparatus and the like caused by rotation of the developing sleeve for a long period of time in the detection processing for detection of the toner adhesion amount are prevented.

Figure 6:
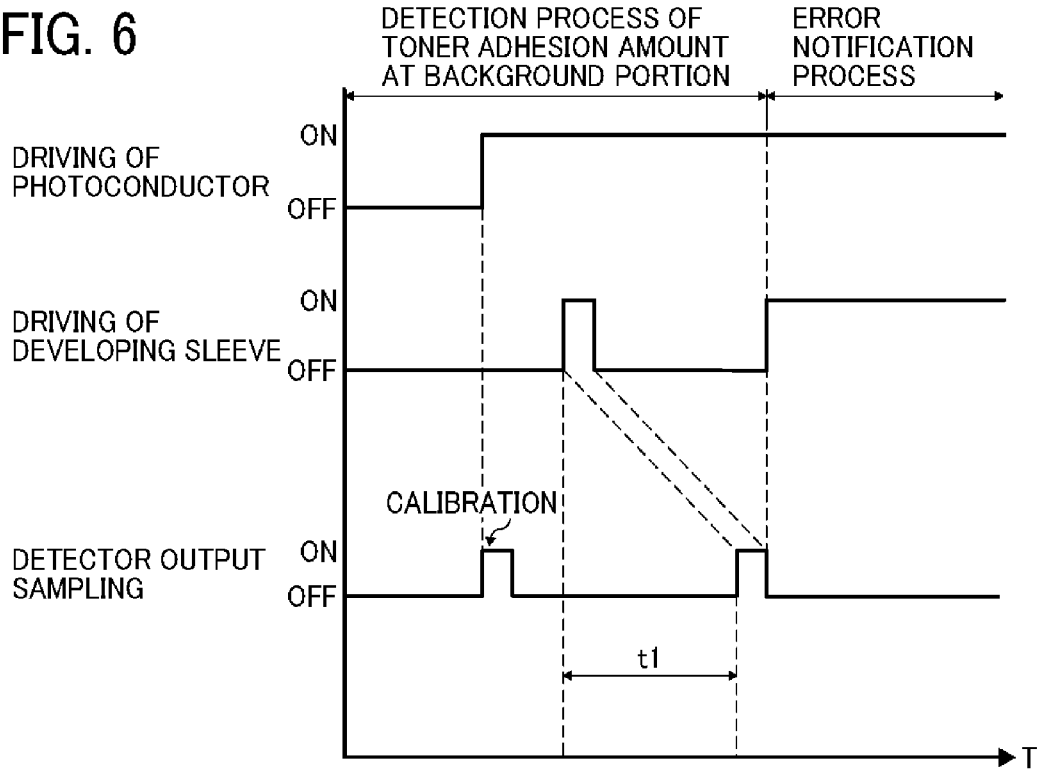
FIG. 6 is a timing diagram showing an operation sequence when an error is not present.

FIG. 6 is a timing diagram showing an operation sequence when errors are not present. If errors are not present, as illustrated in FIG. 6, immediately after the error notification processing starts, the developing clutch 111K transmits power to the developing sleeve. The developing sleeve starts to rotate.

It is to be noted that the optical detector 150 is disposed to detect the toner adhesion amount on the front surface of the conveyor belt 15. Alternatively, in some embodiments, the optical detector 150 may detect the toner adhesion amount on the surface of the photoconductor. In this case, however, four optical detectors 150 corresponding to each of the photoconductors are needed to detect errors for each color. By contrast, when detecting the toner adhesion amount on the conveyor belt 15, only one optical detector 150 is needed, which is cost-saving.

The present disclosure is applied to the direct-transfer type image forming apparatus in which the toner image on the photoconductor 1 is directly transferred onto the recording medium on the conveyor belt 15. The present disclosure can be also applied to an intermediate-transfer type image forming apparatus in which the toner image on the photoconductor 1 is transferred onto an intermediate transfer body before transferred onto a recording medium.

With reference to FIG. 7, a description is provided of another illustrative embodiment of the present disclosure. The same reference numerals used in FIGS. 1 and 2 will be given to constituent elements such as parts and materials having the same functions, and the descriptions thereof will be omitted.

According to the present illustrative embodiment, the controller 100 determines whether or not errors are present based on the toner adhesion amount for each of four colors black, magenta, yellow, and cyan during preparation running.

Figure 7A:
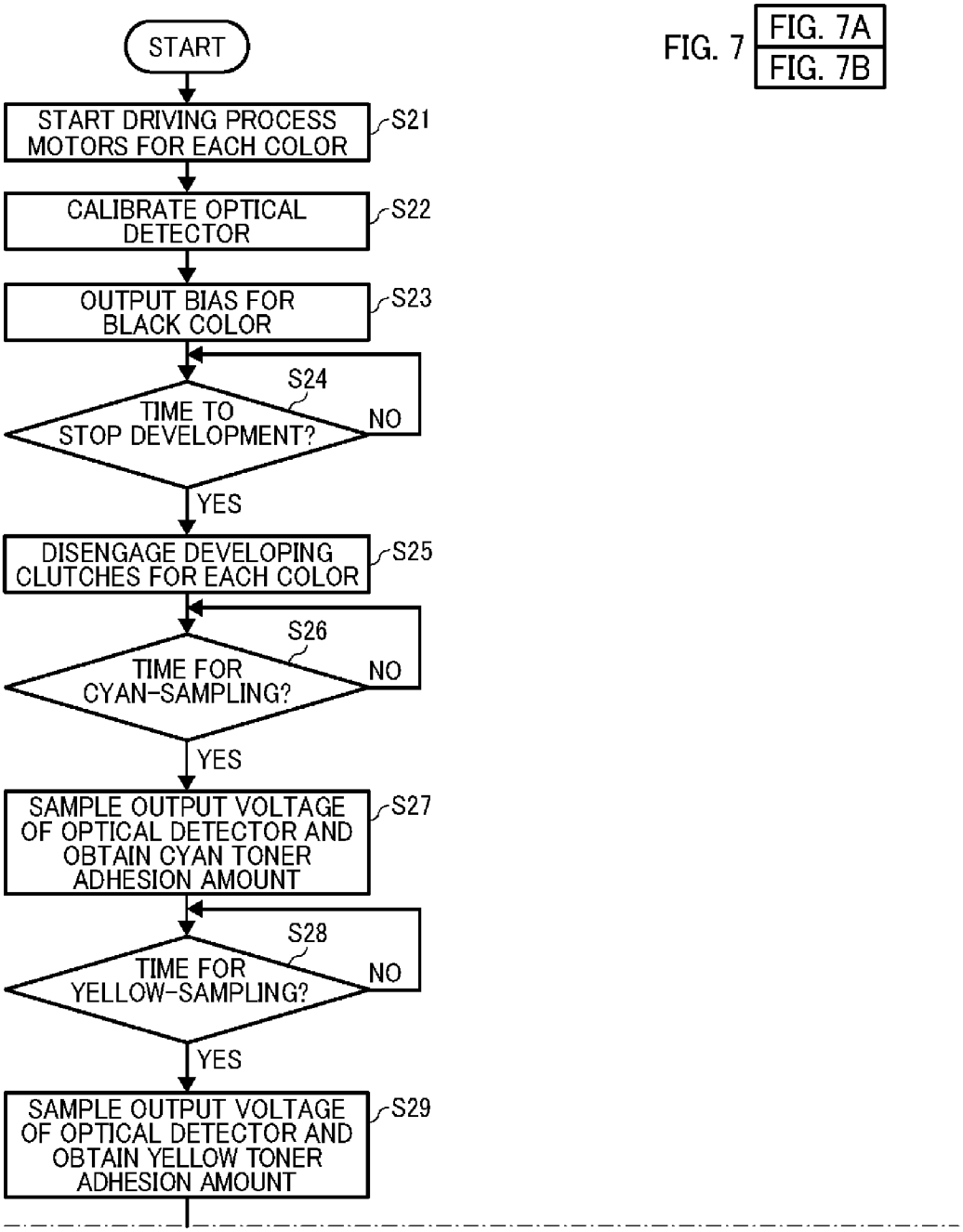
FIG. 7A is a flowchart showing steps of a routine processing performed by the controller of the image forming apparatus during the preparation running according to an illustrative embodiment of the present disclosure.
Figure 7B:
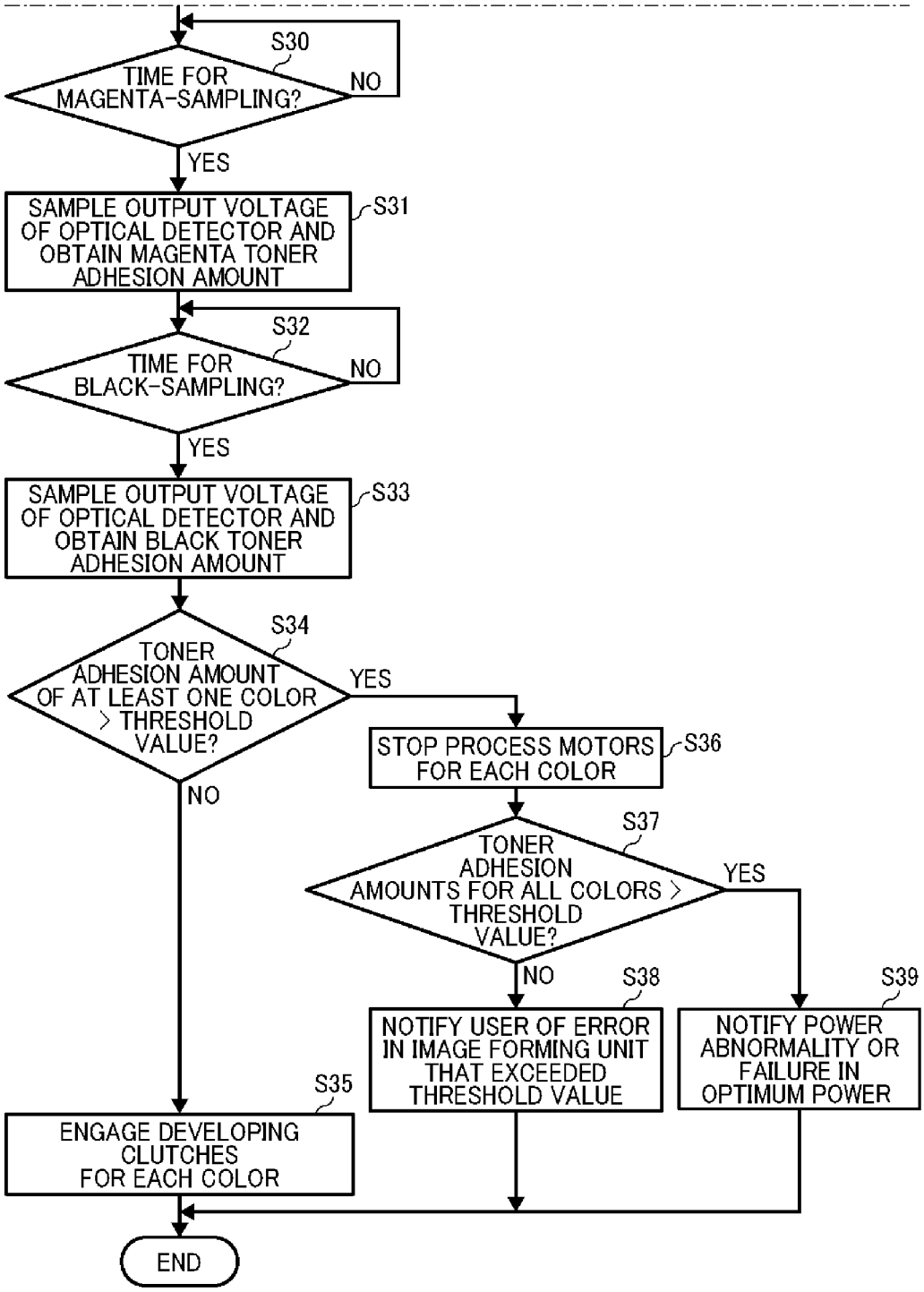
FIG. 7B is a flowchart showing steps of a routine processing performed by the controller of the image forming apparatus during the preparation running according to an illustrative embodiment of the present disclosure.

FIGS. 7A and 7B illustrate a flowchart showing steps of a routine processing by the controller 100 of the image forming apparatus during the preparation running according to another illustrative embodiment of the present disclosure. Steps S26 through S33 in the flowchart are associated with the detection processing for detection of the toner adhesion amount at the background portion. Steps S34 through S39 are associated with the error notification processing.

When starting the preparation running, the controller 100 starts to drive the process motors 110K, 110M, 110Y, and 110C at step S21. In the meantime, the developing sleeves for each color are rotated by engaging the developing clutches 111K, 111M, 111Y, and 111C. Furthermore, the drive motor for the conveyor belt 15 is also driven so as to rotate the conveyor belt 15 endlessly.

After calibration of the optical detector 150 at step S22, the controller 100 controls the first power source 112, the second power source 113, and the third power source 114 to output the charging bias, the developing bias, and the transfer bias for the color black, respectively, at step S23.

After the controller 100 enables the power sources to output the respective bias, the controller 100 determines whether or not it is time to stop developing process at step S24. The timing at which the developing process is stopped is a time after the developing clutches 111K, 111M, 111Y, and 111C are engaged, but before a travel time elapses. The travel time refers to a required time for the surface of each of the photoconductors 1K, 1M, 1Y, and 1C to travel the same distance as a unit interval between the nip entry of the transfer nip of the preceding photoconductor and the nip entry of the transfer nip of the following photoconductor. The unit interval coincides with an arrangement pitch of the image forming units 17K, 17M, 17Y, and 17C. For example, the arrangement pitch is a distance between the nip entry of the transfer nip for black and the nip entry of the transfer nip for the successive color, i.e., magenta.

Assuming that in each of the image forming units 17K, 17M, 17Y, and 17C, the surface travel distance of the photoconductors is greater than the unit interval after the developing sleeve starts to rotate while the developing sleeve rotates. Since the above-described surface travel distance coincides with the length of the region R1 of the background portion, the length of region R1 is greater than the unit interval. As a result, toners in multiple colors are transferred overlappingly onto the conveyor belt 15. For example, if the region R1 has a length of 120 mm despite the unit interval of 100 mm, the toners in four different colors, i.e., black, magenta, yellow, and cyan are overlappingly transferred onto an area of 20 mm (120−100=20) of the conveyor belt 15.

In view of the above, the controller 100 stops the developing process after the developing clutches 111K, 111M, 111Y, and 111C are engaged, but before the travel time elapses. With this configuration, the length of the region R1 of each of the photoconductors is less than the unit interval, thereby preventing undesirable overlapping transfer of multiple toners on the conveyor belt 15.

When the time to stop the developing process comes (Yes, at step S24), the controller 100 disengages each of the developing clutches 111K, 111M, 111Y, and 111C to stop rotation of the developing sleeves (step S25). Subsequently, the controller 100 starts the detection processing for detection of the toner adhesion amount at the background portion.

In the detection processing for detection of the toner adhesion amount at the background portion, the controller 100 waits for a sampling timing for cyan at step S16. The sampling timing for cyan (hereinafter refers to cyan sampling timing) refers to a time at which a region (hereinafter referred to as a cyan belt region BR1*c*) of the conveyor belt 15 that has tightly contacted the region R1 of the photoconductor 1C in the transfer nip for cyan advances to the opposite position to the optical detector 150. The cyan sampling timing can be specified through a time count processing from the time at which the developing clutch 111C is engaged.

When the cyan sampling timing arrives (Yes at step S26), the controller 110 takes a sample of an output voltage from the optical detector 150, and based on the result, the toner adhesion amount of the cyan toner at the cyan belt region BR1*c* is obtained at step S27. Subsequently, at step S28, the controller 100 waits for a sampling timing (hereinafter refers to as yellow sampling timing) for yellow. The yellow sampling timing refers to a time at which a region (hereinafter refers to as a yellow belt region BR1*y*) of the conveyor belt 15 that has tightly contacted the region R1 of the photoconductor 1Y in the transfer nip for yellow advances to the opposite position to the optical detector 150. The yellow sampling timing can be specified through a time count processing from the time at which the developing clutch 111Y is engaged.

When the yellow sampling timing arrives (Yes at step S28), the controller 110 takes a sample of an output voltage from the optical detector 150, and based on the result the toner adhesion amount of the yellow toner at the yellow belt region BR1*y* associated with the region R1 is obtained at step S29. Subsequently, at step S30, the controller 100 waits for a sampling timing (hereinafter refers to as magenta sampling timing) for magenta. The magenta sampling timing refers to a time at which a region (hereinafter refers to as a magenta belt region BR1*m*) of the conveyor belt 15 that has tightly contacted the region R1 of the photoconductor 1M in the transfer nip for magenta advances to the opposite position to the optical detector 150. The magenta sampling timing can be specified through a time count processing from the time at which the developing clutch 111M is engaged.

When the magenta sampling timing arrives (Yes at step S30), the controller 110 takes a sample of an output voltage from the optical detector 150, and based on the result the toner adhesion amount of the magenta toner at the magenta belt region BR1*m* associated with the region R1 is obtained at step S31. Subsequently, at step S32, the controller 100 waits for a sampling timing (hereinafter refers to as black sampling timing) for black. The black sampling timing refers to a time at which the belt region BR1*k* of the conveyor belt 15 that has tightly contacted the region R1 of the photoconductor 1K in the transfer nip for black advances to the opposite position to the optical detector 150. The black sampling timing can be specified through a time count processing from the time at which the developing clutch 111K is engaged.

When the black sampling timing arrives (Yes at step S32), the controller 110 takes a sample of an output voltage from the optical detector 150, and based on the result the toner adhesion amount of the black toner at the black belt region BR1*k* associated with the region R1 of the photoconductor 1K is obtained at step S33. This ends the detection processing.

Subsequently, after the detection processing for detection of the toner adhesion amount of the background portion, the controller 100 starts the error notification processing. At step S34, whether or not the toner adhesion amount for at least one color among four colors black, magenta, yellow, and cyan exceeds the threshold value is determined. If the toner adhesion amount does not exceed the threshold value in any of the colors at step S35, the developing clutches 111K, 111M, 111C, and 111Y are engaged to start rotation of the developing sleeves for each color again at step S35, thereby finishing a sequence of routine processing.

By contrast, if the toner adhesion amount for at least one of the colors exceeds the threshold value (Yes at S34), all of the process motors 110K, 110M, 110Y, and 110C are stopped at step S36. Subsequently, whether or not the toner adhesion amount for all colors exceeds the threshold value is determined at step S37.

The reason for performing such a processing is explained as follows. In a case in which the toner adhesion amount exceeds the threshold value in one color or some of the colors among all the colors, that is, only one toner or some of toners among all toners sticks to the photoconductor, it is highly possible that an error is present in the image forming unit of that particular color only. For example, the charging brush roller may be damaged in the image forming unit of that color. By contrast, in a case in which the threshold value of the toner adhesion amount exceeds in all colors, that is, toner adhesion occurs to all of the photoconductors, it is highly possible that errors are present in the first power source 112 and second power source 113 which are common to all the colors, or something is wrong with the power distribution.

In view of the above, in a case in which the toner adhesion amount exceeds the threshold value in only one or some of colors (No at step S37), the controller 100 notifies the user of the error of the image forming unit which exceeds the threshold value at step S38, and finishes a sequence of routine processing. By contrast, in a case in which the toner adhesion amount exceeds the threshold value in all the colors (Yes at step S37), the controller 100 notifies the user of the error in the power supply or in the power distribution at step S39, and ends a sequence of routine processing.

According to the present illustrative embodiment, the first power source 112 outputs a charging bias for each color, and the second power source 113 outputs a developing bias for each color. Alternatively, in some embodiments, a separate charging power source is dedicated to black and other colors, i.e., magenta, yellow, and cyan. That is, a charging power source for black outputs a charging bias for black, and a charging power source (hereinafter referred to as a color charging power source) for other colors, i.e., magenta, yellow, and cyan outputs charging biases for each of the colors magenta, yellow, and cyan.

Similarly, a different developing power source is dedicated for black and other colors. That is, a developing power source for black outputs a developing bias for black, and a developing power source (hereinafter referred to as a color developing power source) for other colors outputs developing biases for magenta, yellow, and cyan. In this configuration, in a case in which the toner adhesion amount exceeds the threshold value in each of the three colors, i.e., magenta, yellow, and cyan, it is determined that errors are present in the color charging power source and the color developing power source.

As described above, according to the present illustrative embodiments, the driving device drives the photoconductors and the developing sleeves, and is also capable of driving only the photoconductors in the image forming unit 17K, 17M, 17Y, and 17C. The optical detector 150 detects the toner adhesion amount at the four belt regions BR1*k*, BR1*m*, BR1*y*, and BR1*c* of the conveyor belt 15 associated with the region R1 of the background portion of the photoconductors 1K, 1M, 1Y, and 1C. The four belt regions BR1*k*, BR1*m*, BR1*y*, and BR1*c* have contacted tightly the region R1 of the background portion of the photoconductors 1K, 1M, 1Y, and 1C.

Furthermore, in the error notification processing, in a case in which at least one of the results of detection of the toner adhesion amount at the four belt regions BR1*k*, BR1*m*, BR1*y*, and BR1*c* corresponding to four colors exceeds a predetermined threshold, the controller 100 carries out the error notification processing. With this configuration, errors can be detected for each of the image forming units 17K, 17M, 17Y, and 17C According to the present illustrative embodiment, during the preparation running, the controller 100 carries out the following processing. The controller 100 starts to drive the photoconductors 1K, 1M, 1Y, and 1C and the developing sleeves in the image forming units 17K, 17M, 17Y, and 17C. Subsequently, before moving the surface of the photoconductors 1K, 1M, 1Y, and 1C by the same distance as the unit interval or the arrangement pitch, the controller 100 stops to drive the developing sleeves in the image forming units 17K, 17M, 17Y, and 17C. With this configuration, as described above, the toners of yellow, magenta, cyan, and black adhered to the photoconductors 1Y, 1M, 1C, and 1K undesirably due to occurrence of errors are prevented from getting transferred overlappingly onto a portion of the conveyor belt 15.

According to the present illustrative embodiment, in the detection processing for detection of the toner adhesion amount at the background portion, the optical detector 150 detects the toner adhesion amount at the four belt regions BR1*k*, BR1*m*, BR1*y*, and BR1*c* of the conveyor belt 15 associated with the region R1 of the photoconductors 1K, 1M, 1Y, and 1C. Subsequently, the controller 100 carries out the error notification processing in which an error is reported as needed. With this configuration, errors are reported after detection of the toner adhesion to the photoconductors for all four colors due to occurrence of errors, hence preventing lack of notification of errors in some of the colors.

According to the present illustrative embodiment, the error notification processing is carried out after the detection processing for detection of the toner adhesion amount at the background portion. Alternatively, in some embodiments, the detection processing for detection of the toner adhesion amount at the background portion and determination of presence of an error in the error notification processing can be performed in parallel.

According to the present illustrative embodiment, the controller 100 carries out the following processing in the error notification processing. That is, in a case in which the detection result of the toner adhesion amount does not exceed at any of the belt regions BR1*k*, BR1*m*, BR1*y*, and BR1*c*, the developing sleeves in the image forming units 17K, 17M, 17Y, and 17C are driven again. With this configuration, when it is determined that there is no error, the developing sleeves for each color can be driven quickly, hence reducing an initial print time after the preparation running.

According to the present illustrative embodiment, the controller 100 carries out the following processing in the error notification processing. That is, in a case in which the detection result of the toner adhesion amount exceeds at least one of the belt regions BR1*k*, BR1*m*, BR1*y*, and BR1*c*, all four photoconductors 1K, 1M, 1Y, and 1C are stopped. With this configuration, when it is determined that there is an error, rotation of the photoconductors 1K, 1M, 1Y, and 1C is stopped quickly, thereby preventing contamination of interior of the apparatus and damage to the cleaning blade.

According to the present illustrative embodiment, the controller 100 carries out the following processing in the error notification processing. That is, in a case in which the detection result of the toner adhesion amount exceeds at all of the belt regions BR1*k*, BR1*m*, BR1*y*, and BR1*c*, the error is reported that there is an error in the power source output or in the power distribution. With this configuration, the error related to the image forming units and the error related to the power source output and the power distribution can be distinguished and reported.

Although the embodiment of the present disclosure has been described above, the present disclosure is not limited to the foregoing embodiments, but a variety of modifications can naturally be made within the scope of the present disclosure.

[Aspect A]

In Aspect A, an image forming apparatus includes a latent image bearer (e.g., the photoconductor 1) to bear a latent image on a surface thereof, a latent image forming device (e.g., the optical writing unit 16) to form the latent image on the surface of the latent image bearer, a developing device (e.g., the developing device 3) including a developer bearer (e.g., the developing sleeve) to develop the latent image with toner carried on the developer bearer, a driving device (e.g., the process motors 110) to drive the latent image bearer and the developer bearer together and individually, a transfer body (e.g., the conveyor belt 15) onto which toner on the surface of the latent image bearer is transferred, a toner detector (e.g., the optical detector 150) to detect a toner adhesion amount of toner adhered to one of the surface of the latent image bearer and a surface of the transfer body, an operation display (e.g., the operation display 115) to notify a user of occurrence of errors, and a controller (e.g., the controller 100) to control the toner detector to detect, at a preparation running and while the driving device drives the latent image bearer, one of a toner adhesion amount at a background portion of the latent image bearer and a toner adhesion amount at a background corresponding region of the transfer body in a toner adhesion amount detection, and to control the operation display to notify the user of occurrence of an error in an error notification in a case in which the toner adhesion amount detected in the toner adhesion amount detection is equal to or greater than a predetermined threshold value. The controller controls the driving device to stop only the developer bearer after driving both the latent image bearer and the developer bearer at the preparation running, but before a trailing edge of a detection target region of one of the background portion of the latent image bearer and the background corresponding region, at which the toner adhesion amount is detected, advances to an opposite position to the toner detector.

With this configuration, contamination of the interior of the apparatus and the like caused by occurrence of errors can be prevented. In the known image forming apparatus, both the latent image bearer and the developer bearer are kept driven for a predetermined time period, i.e., from the start of the preparation running until determination of presence of an error is completed after the trailing edge of the detection region of the latent image or the transfer body passes through the opposite position to the toner detector. In a case in which an error is present, toner continues to stick to the latent image bearer from the developer bearer during the predetermined time period. As a result, in the configuration in which the toner detector detects the toner adhesion amount on the surface of the latent image bearer, the toner sticks to the entire surface of the latent image bearer from the opposite position to the developer bearer to the opposite position to the toner detector during the predetermined time period.

Furthermore, in the configuration in which the toner detector detects the toner adhesion amount on the surface of the transfer body, the toner keeps sticking to the entire surface of the latent image bearer from the opposite position to the developer bearer to the transfer position during the above-mentioned time period. By contrast, according to Aspect A, during the preparation running both the latent image bearer and the developer bearer are driven, and then only the developer bearer is stopped prior to guiding the trailing edge of the detection region of the latent image bearer or the transfer body to the opposite position to the toner detector.

With this configuration, stopping the developer bearer before the above-mentioned time period elapses can prevent the developing agent from sticking to the latent image bearer. At the time when the above-mentioned time period elapses, the toner adhesion amount on the surface of the latent image bearer from the opposite position to the developer bearer to the position which was opposite to the developer bearer immediately after the developer bearer stopped in the past is significantly small. In other words, according to Aspect A, the toner adhesion amount on the latent image bearer when occurrence of errors is confirmed can be less than that in the related-art configuration. With this configuration, contamination of the interior of the apparatus and the like caused by the error can be prevented.

Aspect

According to Aspect A, during the preparation running the controller stops driving the developer bearer prior to guiding the leading edge of the detection region to the opposite position to the toner detector. With this configuration, the toner adhesion amount on the latent image bearer can be reduced as compared with a configuration in which the developer bearer is stopped after the above-mentioned region of the latent image bearer or the background portion of the transfer body advances to the opposite position to the toner detector. With this configuration, contamination of the interior of the apparatus and the like caused by the error can be prevented more reliably.

Aspect C

According to Aspect A or Aspect B, the image forming apparatus further includes a plurality of combinations of the latent image bearer and the developing device, and a transfer device to transfer toner from a plurality of latent image bearers onto the surface of the transfer body while the transfer body travels. The driving device drives only the plurality of latent image bearers in the plurality of combinations of the latent image bearer and the developing device, and the toner detector detects the toner adhesion amount at a plurality of detection target regions of the transfer body corresponding to background portions of the plurality of latent image bearers. In the error notification, the controller controls the operation display to notify the user of occurrence of errors in a case in which the toner adhesion amount of one of the plurality of detection target regions of the transfer body is equal to or greater than the threshold value. With this configuration, errors can be detected in every combination.

Aspect D

According to Aspect C, during the preparation running, after the latent image bearer and the developer bearer are driven in each of the plurality of combinations, prior to moving the surface of the plurality of latent image bearers by the same distance as the interval between the latent image bearers, the controller stops driving the developer bearer in each of the plurality of combinations. With this configuration, the toners of yellow, magenta, cyan, and black adhered to the plurality of image bearers undesirably due to occurrence of errors are prevented from getting transferred overlappingly onto a portion of the transfer body.

Aspect E

According to Aspect D, in the toner adhesion amount detection at the background portion, the controller reports errors as needed after the toner adhesion amount at all detection regions corresponding to the background portions of the plurality of latent image bearers is detected. With this configuration, the error is notified after detection of the toner adhesion to the photoconductors for all four colors due to the error, hence preventing lack of notification of the error in some of the colors.

Aspect F

According to Aspect E, in the toner adhesion amount detection at the background portion, the controller reports errors as needed after the toner adhesion amount at all detection regions corresponding to the background portions of the plurality of latent image bearers is detected. With this configuration, when it is determined that there is no error, the developer bearers in the plurality of combinations are driven quickly, hence reducing an initial print time after the preparation running.

Aspect G

According to Aspect E or Aspect F, in a case in which the toner adhesion amount at one of the plurality of the detection target regions of the transfer body is greater than or equal to the threshold value in the toner adhesion amount detection, the controller controls the driving device to stop driving the transfer body and the latent image bearers in all the plurality of the combinations of the latent image bearer and the developing device. With this configuration, when occurrence of errors is confirmed, rotation of the plurality of latent image bearers is stopped quickly, thereby preventing contamination of interior of the apparatus and damage to the cleaning blade.

Aspect H

According to any one of Aspects E through G, in a case in which the toner adhesion amount at one of the plurality of the detection target regions of the transfer body is equal to or greater than the threshold value in the toner adhesion amount detection, the controller controls the operation display to notify the user of occurrence of errors in the combination of the latent image bearer and the developing device with the toner adhesion amount greater than or equal to the threshold value in the error notification. With this configuration, the user is notified of which combination has the error.

Aspect I

According to any one of Aspects E through H, in a case in which the toner adhesion amount at all predetermined combinations of the plurality of the detection target regions of the transfer body is greater than or equal to the threshold value in the toner adhesion amount detection, the controller controls the operation display to notify the user of an error in a power output and a power distribution corresponding to the predetermined combination of the plurality of the detection target regions. With this configuration, abnormality in the combination and abnormality in power output and power distribution are distinguished, and the user is notified of the error accordingly.

According to an aspect of this disclosure, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Each of the functions of the described embodiments may be implemented by one or more processing circuits. A processing circuit includes a programmed processor, as a processor includes a circuitry. A processing circuit also includes devices such as an application specific integrated circuit (ASIC) and conventional circuit components arranged to perform the recited functions.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

a latent image bearer to bear a latent image on a surface thereof;

a latent image forming device to form the latent image on the surface of the latent image bearer;

a developing device including a developer bearer, to develop the latent image with toner carried on the developer bearer;

a driving device to drive the latent image bearer and the developer bearer together and individually;

a transfer body onto which toner on the surface of the latent image bearer is transferred;

a toner detector to detect a toner adhesion amount of toner adhered to one of the surface of the latent image bearer and a surface of the transfer body;

an error notification device to notify a user of occurrence of error; and a controller to control the toner detector to detect, at a preparation running and while the driving device drives the latent image bearer, one of a toner adhesion amount at a background portion of the latent image bearer and a toner adhesion amount at a background corresponding region of the transfer body in a toner adhesion amount detection, and to control the error notification device to notify the user of occurrence of abnormality in an error notification in a case in which the toner adhesion amount detected in the toner adhesion amount detection is equal to or greater than a predetermined threshold value, the controller controlling the driving device to stop only the developer bearer after driving both the latent image bearer and the developer bearer at the preparation running, but before a trailing edge of a detection target region of one of the background portion of the latent image bearer and the background corresponding region of the transfer body, at which the toner adhesion amount is detected, advances to an opposite position to the toner detector.

2. The image forming apparatus according to claim 1, wherein at the preparation running before the trailing edge of the detection target region advances to the opposite position to the toner detector, the controller controls the driving device to stop the developer bearer.

3. The image forming apparatus according to claim 1, further comprising:

a plurality of combinations of the latent image bearer and the developing device; and a transfer device to transfer toner on a plurality of latent image bearers onto the surface of the transfer body while the transfer body travels, wherein the driving device drives the plurality of latent image bearers in the plurality of combinations of the latent image bearer and the developing device, and the toner detector detects the toner adhesion amount at a plurality of detection target regions of the transfer body corresponding to background portions of the plurality of latent image bearers, wherein in the error notification the controller controls the error notification device to notify the user of occurrence of error in a case in which the toner adhesion amount of one of the plurality of detection target regions of the transfer body is equal to or greater than the threshold value.

4. The image forming apparatus according to claim 3, wherein at the preparation running after the plurality of combinations of the latent image bearer and the developing device is driven, but before the surface of the plurality of latent image bearers travels by a same distance as an interval between the plurality of latent image bearers, the controller controls the driving device to stop driving the developer bearers.

5. The image forming apparatus according to claim 4, wherein after the toner detector detects the toner adhesion amount at all the plurality of the detection target regions of the transfer body in the toner adhesion amount detection, the controller controls the error notification device to notify the user of occurrence of error in the error notification as needed.

6. The image forming apparatus according to claim 5, wherein in a case in which the toner adhesion amount at all the plurality of the detection target regions of the transfer body is equal to or less than the threshold value in the toner adhesion amount detection, the controller controls the driving device to start driving the developer bearers again in all the plurality of the combinations of the latent image bearer and the developing device.

7. The image forming apparatus according to claim 5, wherein in a case in which the toner adhesion amount at one of the plurality of the detection target regions of the transfer body is greater than or equal to the threshold value in the toner adhesion amount detection, the controller controls the driving device to stop driving the transfer body and the latent image bearers in all the plurality of the combinations of the latent image bearer and the developing device.

8. The image forming apparatus according to claim 5, wherein in a case in which the toner adhesion amount at one of the plurality of the detection target regions of the transfer body is equal to or greater than the threshold value in the toner adhesion amount detection, the controller controls the error notification device to notify the user of occurrence of error in the combination of the latent image bearer and the developing device with the toner adhesion amount greater than or equal to the threshold value in the error notification.

9. The image forming apparatus according to claim 5, wherein in a case in which the toner adhesion amount at all predetermined combinations of the plurality of the detection target regions of the transfer body is greater than or equal to the threshold value in the toner adhesion amount detection, the controller controls the error notification device to notify the user of an error in a power output and a power distribution corresponding to the predetermined combination of the plurality of the detection target regions.

* * * * *